US010378290B2

(12) United States Patent
Borøy et al.

(10) Patent No.: US 10,378,290 B2
(45) Date of Patent: Aug. 13, 2019

(54) SYSTEM FOR HOISTING A LOAD ON A DRILLING RIG

(71) Applicant: National Oilwell Varco Norway AS, Kristiansand S (NO)

(72) Inventors: Yngvar Borøy, Søgne (NO); Anders Eriksson, Fornebu (NO); Thor Strand, Kristiansand (NO); Anibal B. Teixeira, Kristiansand (NO)

(73) Assignee: National Oilwell Varco Norway AS (NO)

( * ) Notice: Subject to any disclaimer, the term of this patent is extended or adjusted under 35 U.S.C. 154(b) by 68 days.

(21) Appl. No.: 15/539,209

(22) PCT Filed: Dec. 23, 2014

(86) PCT No.: PCT/NO2014/050253
§ 371 (c)(1),
(2) Date: Jun. 23, 2017

(87) PCT Pub. No.: WO2016/105203
PCT Pub. Date: Jun. 30, 2016

(65) Prior Publication Data

US 2017/0356251 A1 Dec. 14, 2017

(51) Int. Cl.
*E21B 15/02* (2006.01)
*E21B 19/084* (2006.01)
(Continued)

(52) U.S. Cl.
CPC ..... *E21B 15/02* (2013.01); *B66D 1/12* (2013.01); *B66D 1/14* (2013.01); *B66D 1/36* (2013.01);
(Continued)

(58) Field of Classification Search
CPC .. B66D 1/36; B66D 1/60; E21B 15/02; E21B 19/084; E21B 19/02; E21B 41/00
See application file for complete search history.

(56) References Cited

U.S. PATENT DOCUMENTS 6,047,781 A * 4/2000 Scott ..... B63B 35/4413 175/5
6,217,258 B1 * 4/2001 Yamamoto ..... E21B 15/02 175/5
(Continued)

FOREIGN PATENT DOCUMENTS

WO WO8501775 4/1985
WO WO0129366 4/2001
(Continued)

OTHER PUBLICATIONS

Written Opinion for PCT/NO2014/050253 dated Jun. 30, 2016 (6 pages).
International Search Report for PCT/NO2014/050253 dated Jun. 30, 2016 (3 pages).

*Primary Examiner* — Emmanuel M Marcelo
(74) *Attorney, Agent, or Firm* — Conley Rose, P.C.

(57) ABSTRACT

A system for hoisting a load on a drilling rig includes: a hoisting means having an elongated hoisting member and an elongated hoisting member drive means; a drill string rotation means suspended from an end of the elongated hoisting member; a support structure having a first side and a second side and being adapted to support at least a portion of the weight the drill string rotation means; a first elongated hoisting member guiding means connected to the support structure; and a counterweight connected to the elongated hoisting member at the second side of the support structure. The elongated hoisting member is reeved over the first elongated hoisting member guiding means from the first to the second side of the support structure. The drill string
(Continued)

rotation means is suspended from the elongated hoisting member at the first side of the support structure.

20 Claims, 4 Drawing Sheets

(51) Int. Cl.

| | |
|---|---|
| ***B66D 1/12*** | (2006.01) |
| ***B66D 1/14*** | (2006.01) |
| ***B66D 1/36*** | (2006.01) |
| ***E21B 41/00*** | (2006.01) |
| *B66D 1/60* | (2006.01) |
| *E21B 19/02* | (2006.01) |

(52) U.S. Cl.
CPC ..... *E21B 19/084* (2013.01); *E21B 41/00* (2013.01); *B66D 1/60* (2013.01); *E21B 19/02* (2013.01)

(56) References Cited

U.S. PATENT DOCUMENTS

| | | | | |
|---|---|---|---|---|
| 2007/0215343 | A1* | 9/2007 | McDonald | E21B 4/006 166/105 |
| 2009/0183918 | A1* | 7/2009 | Stoik | E21B 3/02 175/57 |
| 2010/0057279 | A1* | 3/2010 | Kyllingstad | E21B 19/09 701/21 |
| 2013/0284450 | A1* | 10/2013 | Roodenburg | E21B 15/02 166/352 |
| 2017/0341717 | A1* | 11/2017 | Roodenburg | B63B 35/4413 |

FOREIGN PATENT DOCUMENTS

| | | |
|---|---|---|
| WO | WO2010120169 | 10/2010 |
| WO | WO2011034422 | 3/2011 |

* cited by examiner

SYSTEM FOR HOISTING A LOAD ON A DRILLING RIG

CROSS REFERENCE TO RELATED APPLICATIONS

This application is the U.S. National Stage entry under 35 U.S.C. § 371 of International Patent Application No. PCT/NO2014/050253, filed Dec. 23, 2014, and entitled "System for Hoisting a Load on an Offshore Drilling Rig," which is hereby incorporated by reference in its entirety for all purposes.

TECHNOLOGICAL FIELD

The present disclosure relates to drilling technologies, including offshore drilling. More particularly, the system relates to a system for hoisting a load on a drilling rig, such as an offshore drilling rig.

BACKGROUND

In conventional offshore drilling operations, a top drive is vertically movable in a derrick by means of a drawworks, the drawworks comprising a pulley with a stationary crown block at the top of the derrick and a travelling block connected to and moving together with the top drive. The travelling block and the top drive constitute a travelling assembly. A wire rope runs from a winch through the pulley where it makes several turns around the crown block and travelling block to create a desired mechanical advantage, typically in the range of 16.

The travelling assembly is very heavy, often in the range of 50 to 150 tons, and during drilling operations, it needs to be repeatedly lifted and lowered up and down the derrick. This is an energy-consuming process. Normally, most of the hoisting energy is consumed during tripping, i.e. during the process of pulling the drilling string out of the wellbore and then running it back in. During tripping, it is normally required to lift several hundred tons, often in the range of 500 tons, i.e. the total weight of the travelling assembly and the pipe string. It would be advantageous if the energy consumed in the hoisting loads such as top drives, pipes, pipe strings and pipe stands in offshore drilling operations could be reduced.

Hoisting of heavy loads on drilling rigs has traditionally been done by means of a winch accommodating multiple layers of wire rope. During lifting and lowering, and particularly in heave compensation, the wire rope undergoes numerous bending cycles under load, and is therefore subject to considerable wear. Depending on the number of sheaves in the draw-works, the wire rope on the winch side, the so-called fast line, travels a longer distance than the load, thus requiring multiple layers of wire rope on the winch. Overlying layers of wire rope act with great forces on underlying layers on the winch drum, thus further increasing the wear of the wire rope. Inertia loss in the great number of sheaves in the draw-works also leads to a rather slow acceleration of the load, thus slowing down the operation time. The typical lifetime of a wire rope used together with a multi-layer winch in heave compensation mode on a drilling rig is in the order of two weeks, leading to frequent stops of operation to perform a traditional cut-and-slip to replenish the wire rope.

Prior art hoisting systems on offshore rigs typically use only one wire connected to a winch in one end, running to the top of a derrick through a crown block and down to a travelling block, to which the load is connected, and further to a deadline anchor, typically anchored to the rig floor or to the derrick. When using only one wire, it is of the utmost importance that the wire does not break, as this could cause severe damage to rig and could harm personnel. The fear of wire fatigue also contributes to the frequent replenishment of wire rope. Wires used for heavy lifting operations are very expensive.

Technologies that could increase the lifetime of wire ropes used in hoisting operations, including offshore hoisting operations, and in particular for lifting top drives, drill pipes and stands in active heave compensation and for lifting complete drill strings would be advantageous. Apparatus and systems that improve safety in offshore lifting operations as well as reducing operation times would also be an advance.

BRIEF SUMMARY OF THE DISCLOSURE

In a first aspect, the present disclosure relates to a system for hoisting and rotating a load on a drilling rig, such as an offshore drilling rig, the system comprising:

- a hoisting means including an elongated hoisting member and an elongated hoisting member drive means;
- a drill string rotation means suspended from an end of said elongated hoisting member;
- a support structure having a first side and a second side, the support structure being adapted to support at least a portion of the weight of said drill string rotation means; and
- a first elongated hoisting member guiding means connected to said support structure, said elongated hoisting member being reeved over said elongated hoisting member guiding means from said first side to said second side of the support structure, wherein:
- said drill string rotation means is suspended from said elongated hoisting member at said first side of the support structure; and
- wherein the system further comprises a counterweight connected to said elongated hoisting member at said second side of the support structure.

Importantly, the system according to the present disclosure may be used on land-based drilling rigs, and, as such, is not limited to offshore drilling rigs.

In the most general form of the embodiment of the present disclosure includes a counterweight provided for at least partially balancing out the weight of a drill string rotation means. The counterweight is provided at an opposite side of the support structure from the drill string rotation means and it is connected to the elongated hoisting member from which the drill string rotation means is suspended.

In an exemplary embodiment, said drill string rotation means may be a top drive and said counterweight may be a travelling block, implying the travelling assembly may be split in order to reduce weight having to be lifted and lowered every time the top drive is moved up and down the support structure, typically a derrick. In one example, the weight of a travelling assembly may be in the range of 150 tons, of which the top drive itself contributes around 100 tons and the travelling block contributes around 50 tons. By moving the travelling block to the opposite side of the derrick, i.e. to the side on which the elongated hoisting member drive means is operating, the effective weight of the top drive may be reduced by in the order of 100 tons. In tripping, where the total weight to be lifted normally is in the range of 500 tons, this entails a reduced power consumption of in the order of 20%. As described in the above example, the counterweight may be smaller than the weight of the drill string rotation means, but in other embodiments, the counterweight may even be larger than the weight of the drill string rotation means. This may be the case if the drill string rotation means is less heavy (i.e. weighs less) than in the embodiment above and/or if the travelling block, potentially with an add-on, is particularly heavy. In such embodiment, the system may thus be provided with a small winch or the like in order to lower the drill string rotation means when not connected to a load.

In an embodiment, said elongated hoisting member may comprise two separate portions; a first portion reeved over said elongated hoisting member guiding means directly connecting the top drive and the travelling block, and a second portion connecting the travelling block and the elongated hoisting member drive means. This may be particularly useful for dimensioning of various components of the system for an increased lifetime of the elongated hoisting member as will be described below. The first portion of the elongated hoisting member, directly connecting the top drive and the travelling block, may be provided with a first thickness and a first quality, whereas the second portion of the elongated hoisting member may be provided with a second thickness and a second quality.

In an embodiment, the second portion of the elongated hoisting member may be reeved directly from the elongated hoisting member drive means, over the travelling block and to an anchor, i.e. as a two-part system. In another embodiment, the second portion of the elongated hoisting member may connect the elongated hoisting member drive means to said travelling block via a second elongated hoisting member guiding means, i.e. as a three-part system. In another embodiment, the second portion of the elongated hoisting member may connect the drive means to the travelling block to various multi-part systems, depending on the desired mechanical advantage, often dimensioned by braking requirements.

In an embodiment, said elongated hosting member drive means may be a winch adapted to accommodate only a single layer of elongated hoisting member, i.e. a so-called single-layer winch. A single-layer winch offers several advantages over a multi-layer winch as described in the applicant's own PCT/NO2014/050113 incorporated herein by this reference and to which reference is made for a more thorough description of single-layer winches.

It may further be an advantage if said winch is adapted to accommodate a plurality of parallel elongated hoisting members connecting said winch to said drill string rotation means. This was also described in PCT/NO2014/050113 and reference is made thereto for a more thorough description of the use of parallel wire ropes in offshore drilling operations. In certain embodiments, the single-layer winch may accommodate four or six parallel elongated hoisting members in the form of wire ropes.

In an embodiment, a ratio between the diameter of a winch drum on said winch and the diameter of said second portion of said elongated hoisting member may be larger than 30, and in another embodiment larger than 40, and in still another embodiment 60 or larger. This ratio is often called the D/d ratio, where D is the diameter of the winch drum and d the diameter of the wire rope. The same D/d ratio requirements are valid for the ratio of the diameter of the travelling block, as well as to any other sheave used together with the second portion of the elongated hoisting means, to the diameter of the second portion of said elongated hosting member. A high D/d ratio has been shown to be particularly important for offshore winch applications. Traditionally winches and wire ropes used for offshore drilling applications have had a D/d ratio of around 30. In a system according to the present disclosure, an increased D/d ratio from 30 to 60 increases the lifetime of the wire rope approximately fivefold, thus contributing to increased wire rope lifetime. The use of a single-layer winch with a large winch drum significantly contributes to the increased D/d ratio. Preferably also, the sheaves in the system will have a large D/d ratio, with D now being the diameter of a sheave instead of the diameter of the winch drum. The sheave D/d ratio could also be in the range of 60 or larger. A person skilled in the art will understand that the diameter d of the wire rope will depend on the capacity of the system in which it is to be used, the number of parallel wire ropes and the required safety factor. The safety factor of the wire rope should preferably be 3 or even larger. As an example, in a system with a safe working load of 1500 short tons, six parallel wire ropes with a diameter of 66 millimeters may run over two-parts blocks in the derrick. Sheaves and winch drum may have a D/d ratio of 60 or even larger, thus requiring diameters in the range of four meters. Various embodiments of the hoisting system according to the present disclosure may be adapted to lift from 200 to 750 short tons in well intervention applications, and even up to 2000 short tons in drilling operations. In an embodiment, a ratio between the diameter of said first elongated hoisting member guiding means and said first portion of said elongated hoisting member may also be larger than 30, and in another embodiment larger than 40, and in still another embodiment 60 or larger.

As discussed above, the use of an elongated hoisting member with two different portions may set different requirements with respect to the size of the different components of the system. For instance, the first portion of the elongated hoisting member may be directly connecting the top drive and the travelling block requiring a thicker elongated hoisting member and a larger elongated hoisting member guiding means in order to comply the D/d ratio requirements. As an example, in a system adapted to lift 1500 short tons, the first part of the elongated hoisting member may be a wire rope, or rather six parallel wire ropes, with a diameter of 90 mm, requiring a crown block with a diameter in the range of 5.4 meters in order to obtain a D/d ratio of 60. The second portion of the elongated hoisting member may be a wire rope, or rather six parallel wire ropes, with a diameter of 65 millimeters in a two-part system and 53 millimeters in a three-part system requiring a winch drum and travelling block and potential other sheave diameters of 3.9 meters and 3.2 meters in order to maintain a D/d ratio of 60.

In an embodiment, the first elongated hoisting member guiding means may be a crown block provided at the top of the support structure, the support structure being a derrick.

Said first elongated hoisting member guiding means may be connected to the support structure via a motion compensation means. In order to fulfil requirements for redundancy in offshore drilling operations, the system should have a back-up heave compensation in case of the failure of the elongated hoisting member drive means. A significant advantage achieved by providing compensation means in the elongated guiding member guiding means, typically a crown block's, connection to the support structure is that the required stroke length of the compensation means is halved compared to a normal top-mounted heave compensator. As an example, if it is required to have a stroke length in the order of seven meters for the top-mounted heave compensator, a top-mounted heave compensator in a system according to certain embodiments of the present disclosure will only have to have a stroke length in the order of 3.5 meters, implying a significant cost reduction. The heave compensator may be passive and/or active and of a type know per se.

There is also described an offshore drilling rig comprising a system according to the present disclosure.

In a second aspect the present disclosure relates to the use of a travelling block as a counterweight for a top drive on a drilling rig, the drilling rig being an offshore drilling rig or a land-based drilling rig.

BRIEF DESCRIPTION OF THE DRAWINGS

In the following are described examples of exemplary embodiments illustrated in the accompanying drawings, wherein.

DETAILED DESCRIPTION OF THE DISCLOSED EXEMPLARY EMBODIMENTS

Figure 1:
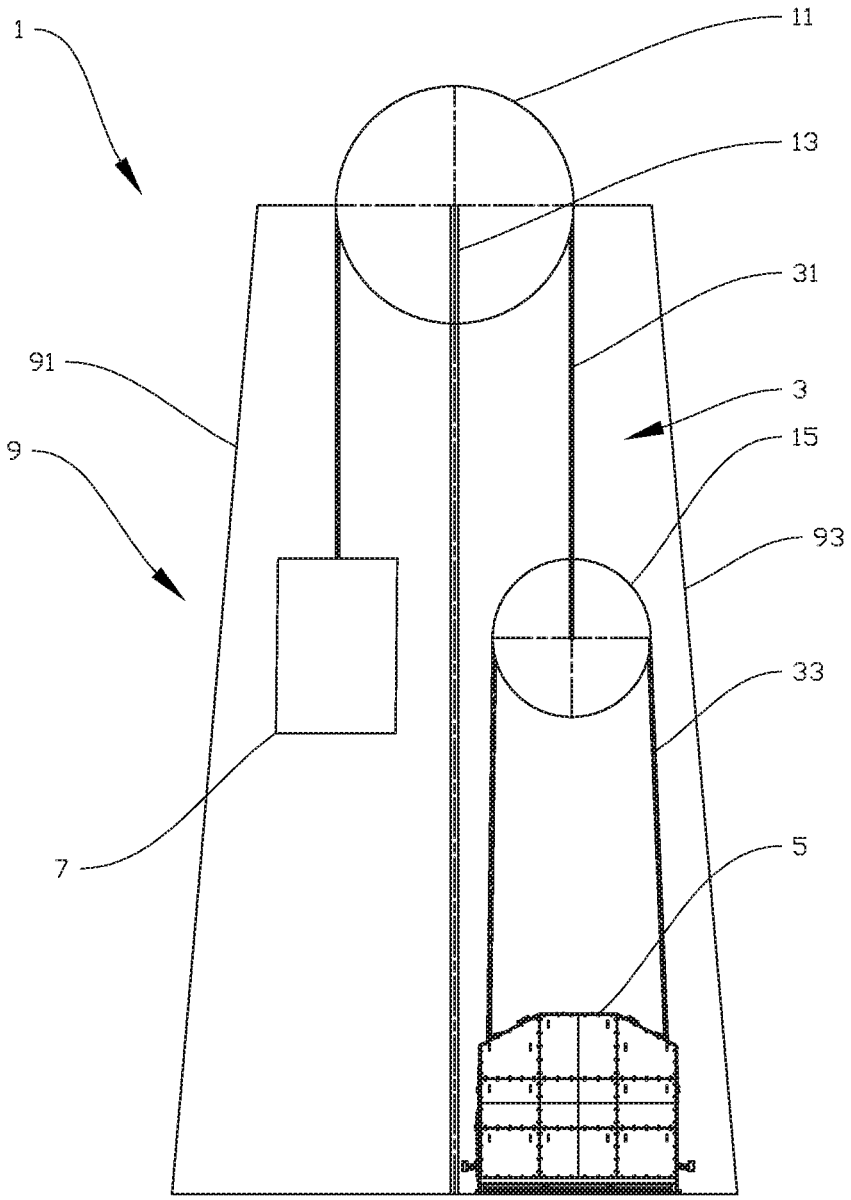
FIG. 1 shows, in a schematic side view, a system according to the present disclosure.

In the following, the reference numeral 1 indicates a hoisting system according to the present disclosure. The figures are shown simplified and schematic and they are not necessarily drawn to scale. Identical reference numerals indicate identical or similar features in the figures.

FIG. 1 shows hoisting system 1 that includes an elongated hoisting member 3, in the form of a wire rope, and an elongated hoisting member drive means 5, in the form of a single-layer winch, is connected to a drill string rotation means 7, in the form of a top drive, at the end of the wire rope 3. The wire rope 3 is suspended from a support structure 9 in the form of a derrick. At the top of the derrick 9 is provided a first elongated hoisting member guiding means 11 in the form of a crown block. The crown block 11 is connected to the derrick 9 via a heave compensator 13 providing the necessary redundancy in case of a winch 5 failure. A first portion 31 of wire rope 3 extends directly from the top drive 7 at a first side 91 of the derrick, over the crown block 11 and to a counterweight 15 in the form of a travelling block at a second side 93 of the derrick 9, the crown block 11 constituting a division between the first side 91 and the second side 93 of the derrick 9 in the shown embodiment. A second portion 33 of the wire rope 3 extends from the travelling block 15 and to the single-layer winch 5, both the travelling block 15, acting as a counterweight for the top drive 7, and the single-layer winch 5 being provided at the second side of the derrick. As also discussed above, the embodiment where the travelling assembly has been split with one part acting as counterweight for the other, also entails the possibility of using different qualities and thicknesses of the two portions 31, 33 of the wire rope 3. The first portion 31 of the wire rope, directly connecting the travelling block 15 and the top drive 7, will have to carry heavier weights than the second portion 33 of the wire rope 3, the second portion 33 running through multiple-part system connecting the travelling block 15 to the single-layer winch 5 as will be described below with reference to FIGS. 3 and 4. The top drive 7 and the travelling block 15 are connected to the derrick 9 by means of not shown dollies.

Figure 2:
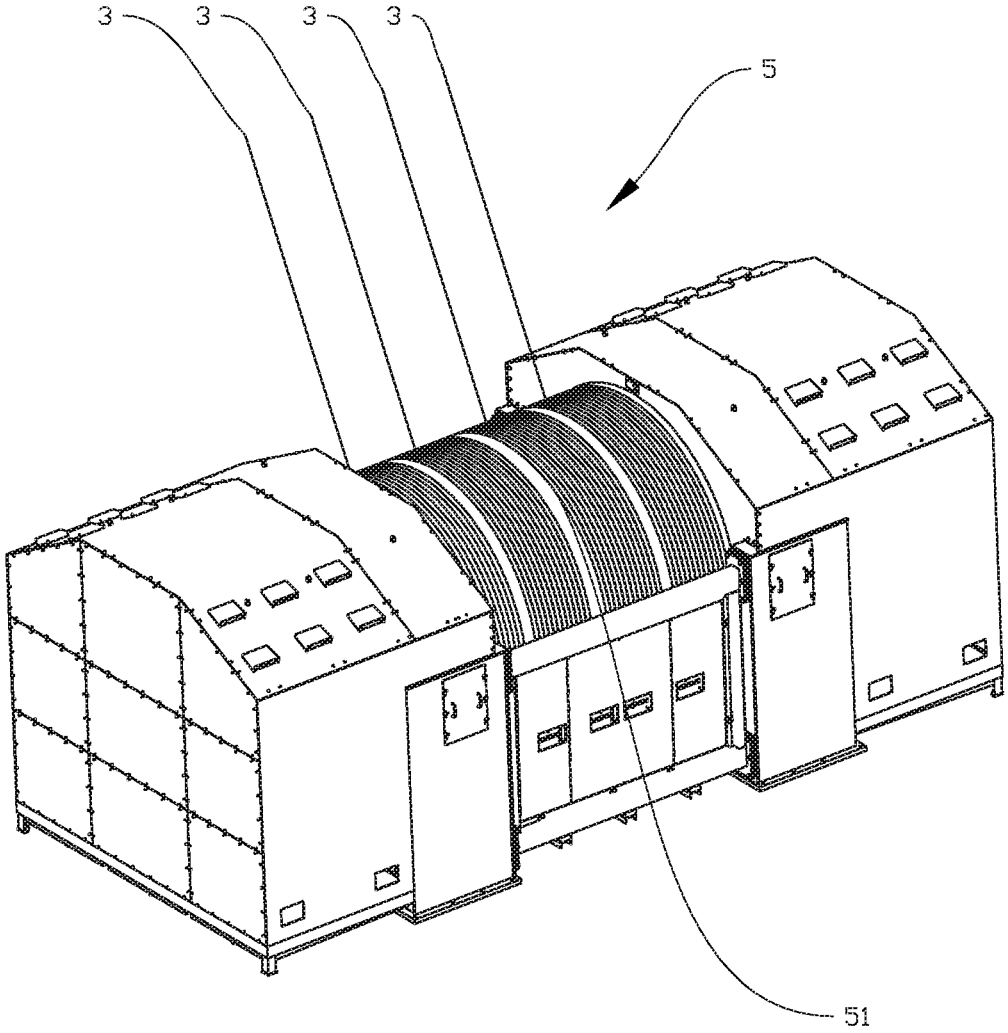
FIG. 2 shows, in a perspective view, a winch as used in a system according to the present disclosure.

FIG. 2 shows a more detailed view of a single-layer winch 5 with a winch drum 51 used in a system 1 according to the present disclosure. The shown single-layer winch 5 accommodates four parallel wire ropes 3 extending from the single-5 layer winch to the top drive 7, where the latter is not shown in this figure. The use of parallel wire ropes 3 and the single-layer winch 5 itself were discussed in PCT/NO2014/050113, and reference is made thereto for an in-depth description.

Figure 3:
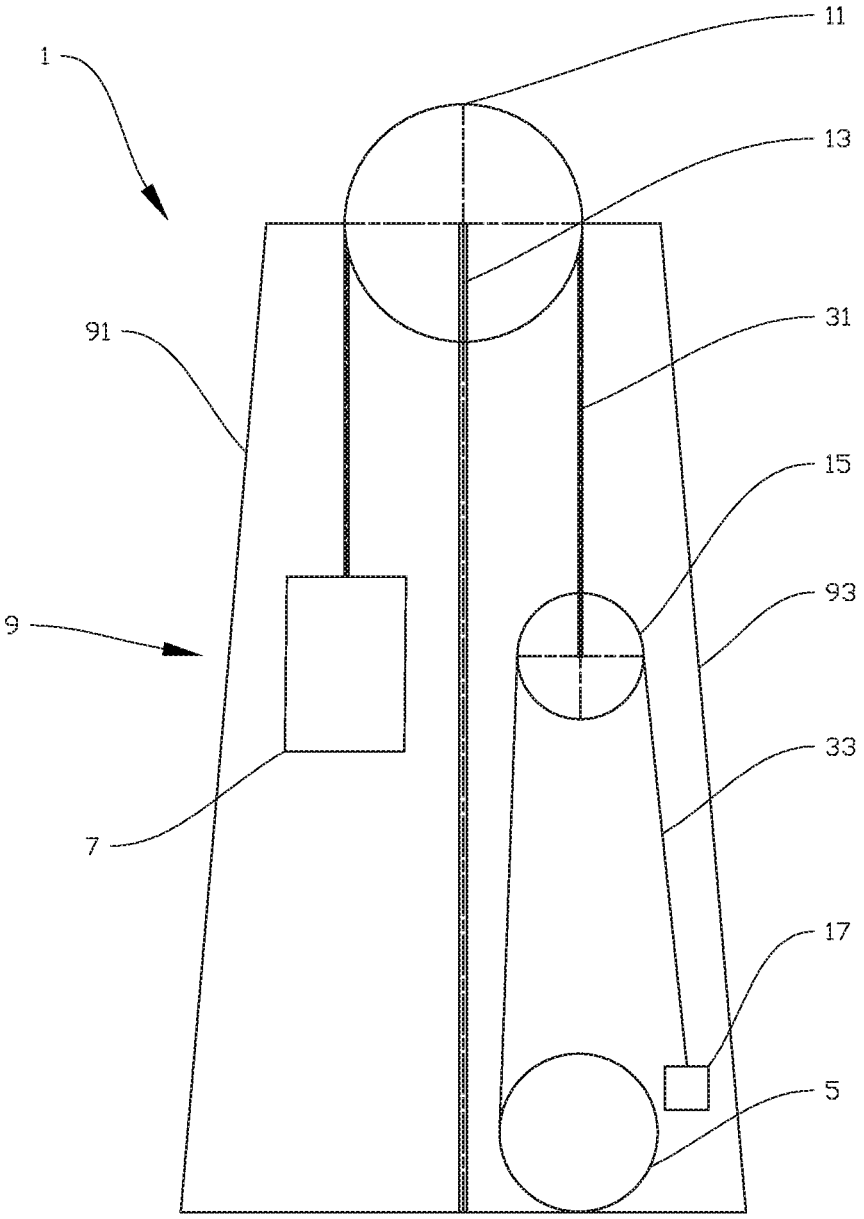
FIG. 3 shows, in a schematic side view, a first embodiment of a system according to the present disclosure.

FIG. 3 shows a system 1 where the second portion 33 of the wire rope 3 connects the single-layer winch 5 to the travelling block in a two part-system. The second portion 33 of the wire rope is reeved directly from the single-layer winch 5, over the travelling block 15 and to an anchor 17. This means that the single-layer winch 5 have to be dimensioned to handle half the weight of the system's capacity. For instance, in a 1500 ton system, the single-layer winch 5 will have to be dimensioned for lifting 750 tons. In this two-part 1500 ton system, the first portion 31 with six parallel steel wire ropes 3 would have to be made with a thickness of approximately 90 millimeters, while the second portion 33 of six parallel wire ropes 3 would have to made with a thickness of 65 millimeters.

Figure 4:
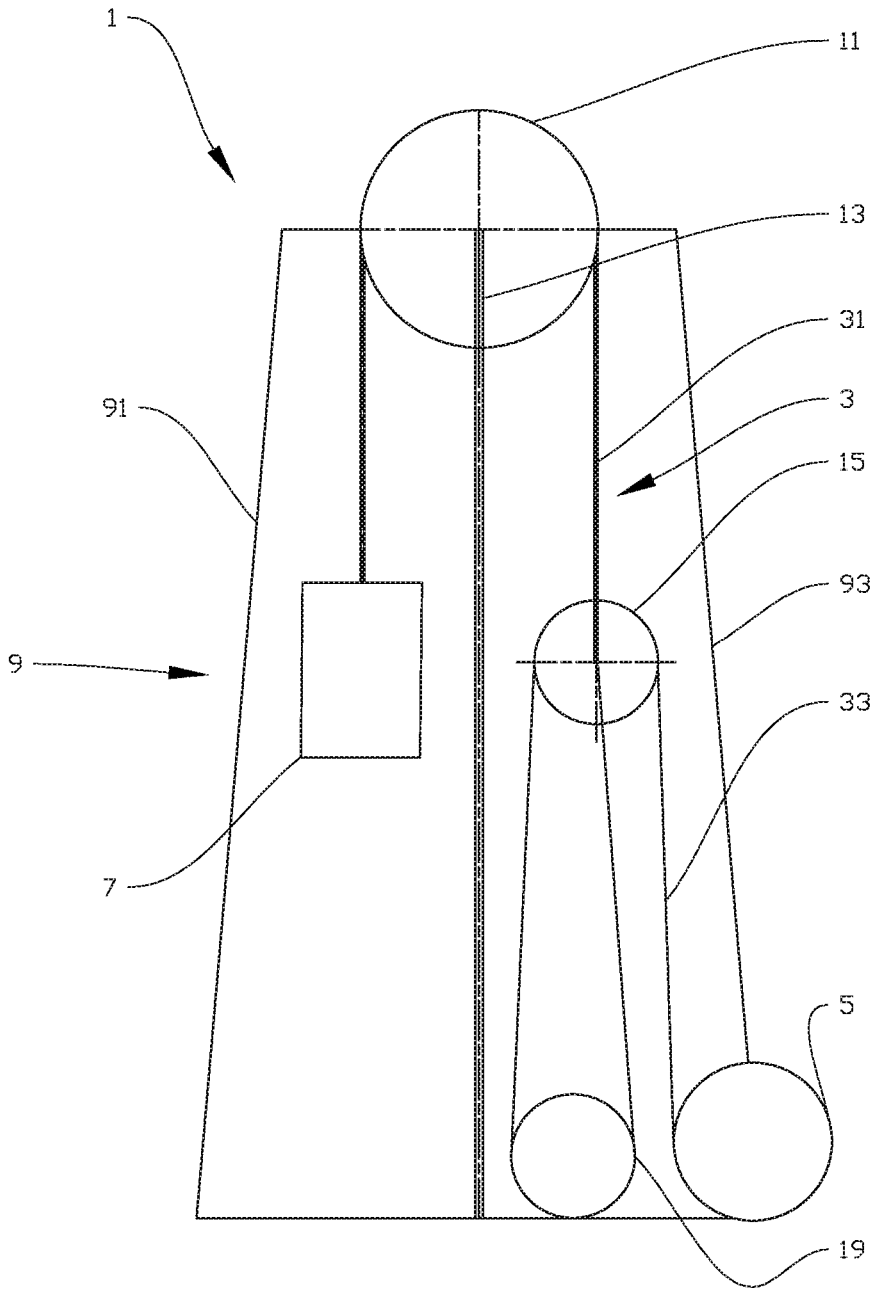
FIG. 4 shows, in schematic side view, a second embodiment of a system according to the present disclosure.

In FIG. 4, the second portion 33 of the wire rope is shown connecting the single-layer winch 5 to the travelling block 15 in a three-part system, where the second portion 33 of the wire rope also is reeved over a second elongated hoisting member guide means 19 in the form of a sheave. In this embodiment, the single-layer winch 5 only have to be dimensioned for lifting one third of the total load capacity of the system 1. Different braking requirements will typically decide which version to choose. In a three-part 1500 ton system 1 with six parallel wire ropes 3, the first portion 31 of the parallel wire ropes 3 would have to be made with a thickness of approximately 90 millimeters, while the second portion 33 of the parallel wire ropes 3 would have be made with a thickness of 53 millimeters.

With an D/d ratio in the order of 60 for both the first portion 31 and the second portion 33 of the wire rope 3 in a system 1 according to the present disclosure, it has been found that it is possible to extend the lifetime of the wire rope 3 up to the order of five years, which is a significant improvement from today's two weeks.

It should be noted that the above-mentioned exemplary embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps that are beyond those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. System for hoisting load on a drilling rig, the system comprising:

a hoisting means including an elongated hoisting member and an elongated hoisting member drive means;

a drill string rotation means suspended from an end of said elongated hoisting member;

a support structure having a first side and a second side, the support structure configured to support at least a portion of the weight of said drill string rotation means; and a first elongated hoisting member guiding means connected to said support structure, said elongated hoisting member being reeved over said first elongated hoisting member guiding means from said first side to said second side of the support structure;

a counterweight connected to said elongated hoisting member at said second side of the support structure;

wherein said drill string rotation means is suspended from said elongated hoisting member at said first side of the support structure.

2. System according to claim 1, wherein the weight of said counterweight is less than the weight of said drill string rotation means.

3. System according to claim 2, wherein said elongated hoisting member comprises two separate portions; a first portion reeved over said first elongated hoisting member guiding means directly connecting the drill string rotation means and the counterweight, and a second portion connecting the counterweight and the elongated hoisting member drive means.

4. System according to claim 3, wherein said second portion of the elongated hoisting member is reeved directly from the elongated hoisting member drive means over the counterweight and to an anchor.

5. System according to claim 3, wherein said second portion of the elongated hoisting member connects said elongated hoisting member drive means to said counterweight via a second elongated hoisting member guiding means.

6. System according to claim 1, wherein the weight of said counterweight is greater than the weight of said drill string rotation means.

7. System according to claim 1, wherein said elongated hosting member drive means is a winch adapted to accommodate only a single layer of elongated hoisting member.

8. System according to claim 7, wherein said winch is adapted to accommodate a plurality of parallel elongated hoisting members connecting said winch to said drill string rotation means.

9. System according to claim 7, wherein a ratio between a diameter of a winch drum of said winch and a diameter of said second portion of said elongated hoisting member is larger than 30.

10. System according to claim 7, wherein a ratio between a diameter of said first elongated hoisting member guiding means and said first portion of said elongated hoisting member is larger than 30.

11. System according to claim 9 wherein the ratio between the diameter of the winch drum of said winch and the diameter of said second portion of said elongated hoisting member is larger than 60.

12. System according to claim 1, wherein said first elongated hoisting member guiding means is a crown block provided at top of the support structure, the support structure being a derrick.

13. System according to claim 12, wherein the crown block is connected to the derrick via motion compensation means.

14. System according to claim 1 wherein the counterweight comprises a travelling block.

15. System for hoisting load on a drilling rig, the system comprising:

a hoist including an elongated hoisting member and a winch;

a top drive suspended from an end of said elongated hoisting member;

a support structure having a first side and a second side, the support structure configured to support at least a portion of the weight of said top drive; and a first sheave connected to said support structure, said elongated hoisting member being reeved over said first sheave from said first side to said second side of the support structure;

a counterweight connected to said elongated hoisting member at said second side of the support structure;

wherein said top drive is suspended from said elongated hoisting member at said first side of the support structure.

16. System according to claim 15, wherein the weight of said counterweight is greater than the weight of said top drive.

17. System according to claim 15, wherein the weight of said counterweight is less than the weight of said top drive.

18. System according to claim 17, wherein said elongated hoisting member comprises two separate portions; a first portion reeved over said first sheave directly connecting the top drive and the counterweight, and a second portion connecting the counterweight and the winch.

19. System according to claim 18, wherein said second portion of the elongated hoisting member is reeved directly from the winch over the counterweight and to an anchor.

20. System according to claim 18, wherein said second portion of the elongated hoisting member connects said winch to said counterweight via a second sheave.

* * * * *